US006237853B1

(12) United States Patent
Bergmann

(10) Patent No.: US 6,237,853 B1
(45) Date of Patent: May 29, 2001

(54) SANITARY FITTING

(75) Inventor: Konrad Bergmann, Schweich (DE)

(73) Assignee: American Standard Inc., Piscataway, NJ (US)

( * ) Notice: Subject to any disclaimer, the term of this patent is extended or adjusted under 35 U.S.C. 154(b) by 0 days.

(21) Appl. No.: 09/380,624

(22) PCT Filed: Mar. 10, 1998

(86) PCT No.: PCT/EP98/01380

§ 371 Date: Sep. 17, 1999

§ 102(e) Date: Sep. 17, 1999

(87) PCT Pub. No.: WO98/41699

PCT Pub. Date: Sep. 24, 1998

(30) Foreign Application Priority Data

Mar. 17, 1997 (DE) ..... 197 10 782

(51) Int. Cl.[7] ..... G05D 23/13
(52) U.S. Cl. ..... 236/12.12; 236/12.2
(58) Field of Search ..... 236/12.12, 93 B, 236/93 R, 12.1, 12.23

(56) References Cited

U.S. PATENT DOCUMENTS 4,711,392 * 12/1987 Kidouchi et al. ..... 236/12.12
4,842,191 * 6/1989 Bergmann ..... 236/12.12
4,867,375 * 9/1989 Ueki et al. ..... 236/12.12
4,945,943 * 8/1990 Cogger ..... 137/360
5,025,983 * 6/1991 Akita ..... 236/12.2
5,511,723 * 4/1996 Toshio et al. ..... 236/12.12

FOREIGN PATENT DOCUMENTS 403 667 6/1966 (CH) .
1 298 944 7/1969 (DE) .
39 41 106 5/1991 (DE) .

* cited by examiner

*Primary Examiner*—Harry B. Tanner
(74) *Attorney, Agent, or Firm*—Nixon Peabody LLP; David S. Safran

(57) ABSTRACT

A sanitary fitting for attachment to a plumbing wall including a fitting body with a common supply housing, the common supply housing having an elongated shape with a hot water supply and a cold water supply which are positioned in a supply plane substantially perpendicular to the plumbing wall and a valve for closing and/or mixing water flowing through the sanitary fitting, the valve having an elongated shape and being located outside the supply housing underneath the supply plane and the common supply housing, where a lengthwise axis of the valve means extends substantially parallel to a lengthwise axis of the supply housing.

12 Claims, 3 Drawing Sheets

SANITARY FITTING

BACKGROUND OF THE INVENTION

1. Field of the Invention

The invention relates to a sanitary fitting for attachment to a plumbing wall, a fitting body which has a hot water supply and a cold water supply and a valve means which is used for closing and optionally for mixing, the hot water supply and the cold water supply being located in a supply plane which is perpendicular to the plumbing wall.

2. Description of the Related Art

Sanitary fittings of the initially mentioned type are common in practice. They can be surface-type and also flush-mounted fittings; for the invention. In the known sanitary fittings there are the hot water supply and cold water supply on a supply housing which is located roughly horizontally in the installed state of the sanitary fitting and which is connected to the valve means. The valve means is located in the supply plane of the hot water supply and the cold water supply, and proceeding from the plumbing wall, in front of the supply housing. Based on this arrangement the known sanitary fitting projects comparatively far away from the plumbing wall. For certain applications, this represents a major disadvantage, especially in small shower stalls, in which there is only little space for the user.

SUMMARY OF THE INVENTION

The object of the invention is to make available a sanitary fitting of the initially mentioned type which projects as little as possible from the plumbing wall and which thus, has an overall depth as small as possible.

The aforementioned object in a sanitary fitting and especially also a surface-type fitting of the initially mentioned type, is achieved in accordance with the present invention by the valve means being located outside, i.e. underneath or above the supply plane. The invention thus represents a completely new arrangement which is characterized by a very low overall depth, i.e. is structurally very flat, since the valve means is no longer located in the supply plane like with the hot water supply and the cold water supply. In this way it is possible to reduce the overall depth of the sanitary fitting by the length or the overall depth of the valve means. In small shower stalls, this is a major advantage since the usable space in the shower stall is considerably increased thereby.

Other features, advantages and possible applications of this invention follow from the following description of embodiments using the drawings, and the drawings themselves.

DETAILED DESCRIPTION OF THE INVENTION

Figure 1:
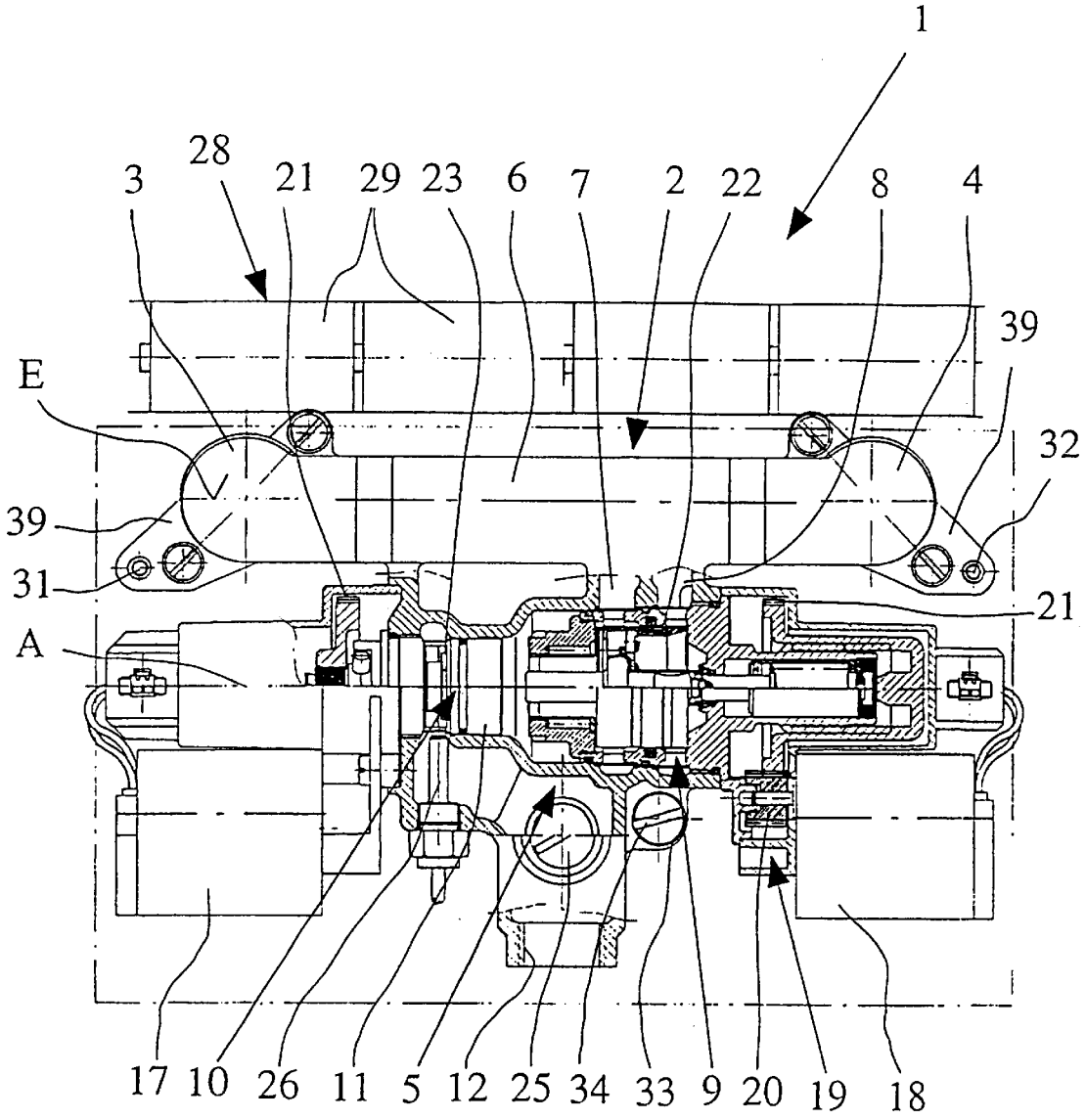
FIG. 1 shows a front view of a sanitary fitting as claimed in the invention, in part in cross section, with the cover removed.
Figure 2:
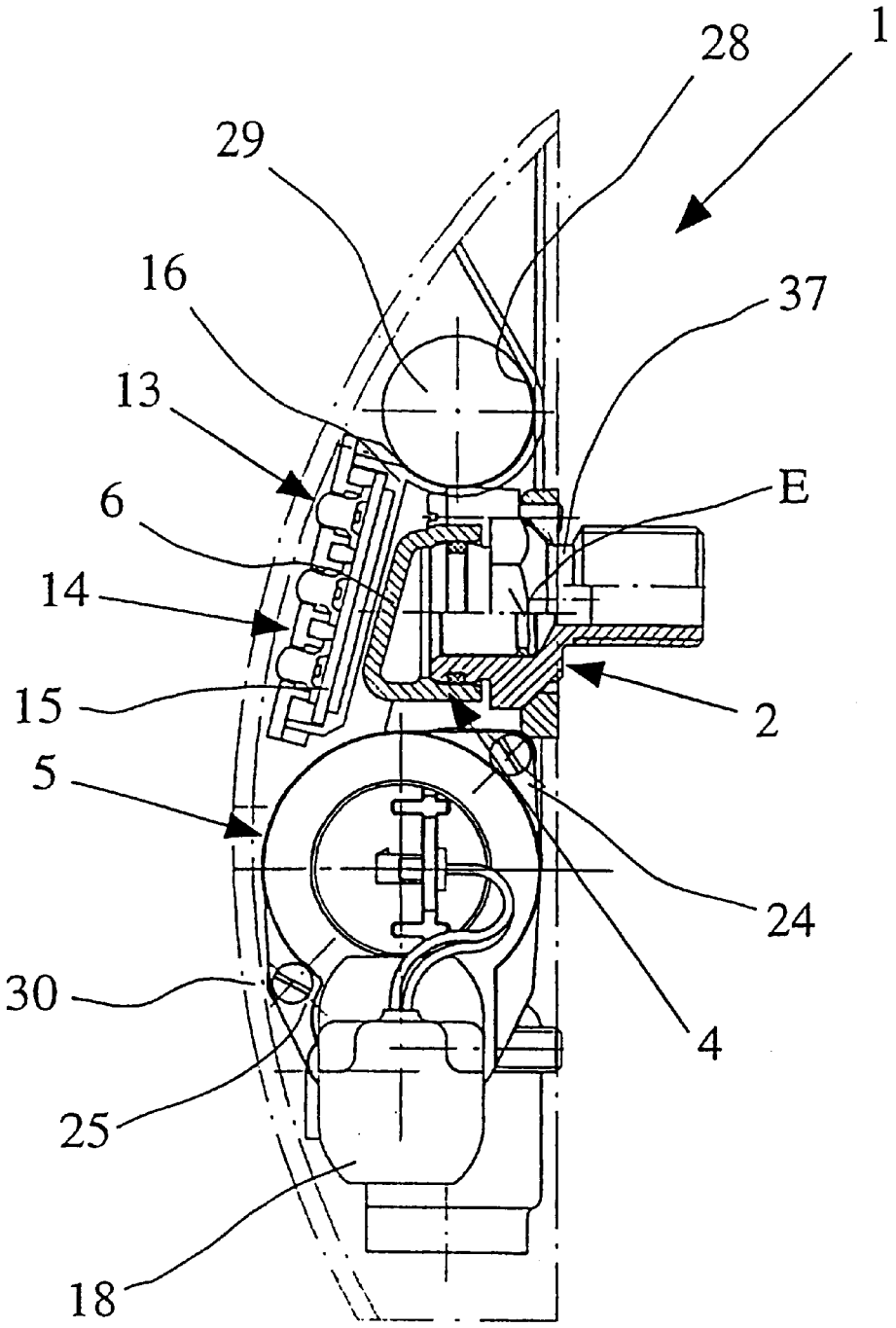
FIG. 2 shows a side view of the sanitary fitting as claimed in the invention with the cover in place and FIG. 3 shows an overhead view of the sanitary fitting from FIG. 1, but without the battery compartment indicated in FIG. 1.
Figure 3:
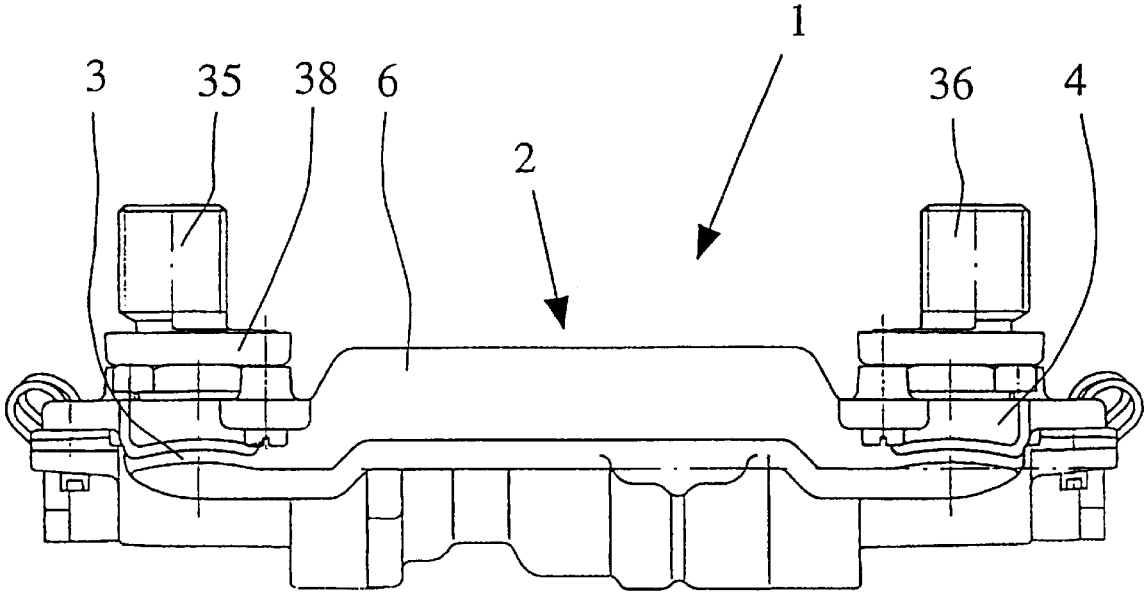

The figures show a sanitary fitting 1 which is a surface-type fitting for attachment to a plumbing wall which is not detailed. But the sanitary fitting could also be a flush-mounted fitting. The sanitary fitting 1 has a fitting body 2 which is provided with a hot water supply 3 and a cold water supply 4. Furthermore, the sanitary fitting 1 has a valve means 5 which is located within the fitting body 2 and which is used at least for closing and also for mixing the water. In particular, FIG. 1 shows that the hot water supply 3 and the cold water supply 4 are located in a common supply plane E which runs perpendicular to the plumbing wall which is not shown in the installed state of the sanitary fitting 1.

At this point, it is important that the valve means 5 is located, not in the supply plane E, but outside it, i.e. above or below this supply plane E. The arrangement of the valve means 5 above or below the supply plane E means that none of the valves of the valve means 5, is located in the supply plane E and the valve means 5 preferably does not touch the supply plane E. As described above, this leads to a considerable reduction of the overall depth of the sanitary fitting 1.

In construction terms the arrangement of the sanitary fitting 1 in accordance with one embodiment of the present invention is made such that the hot water supply 3 and the cold water supply 4 are on a common supply housing 6 of the fitting body 2, i.e. the housing which runs roughly horizontally in the installed state of the sanitary fitting 1. From the supply housing 6, both a hot water exit 7 and a cold water exit 8 proceed to the valve means 5, the hot water exit 7 and the cold water exit 8 being located roughly perpendicularly to the supply plane E.

To achieve a compact and flat structure of the sanitary fitting 1, the valve means 5 has an elongated shape, the lengthwise axis A of the valve means 5 running parallel to the supply housing 6. Of course, it is also basically possible to arrange the valve means perpendicular to the supply housing. In this way embodiment the sanitary fitting would have a comparatively large lengthwise extension. In the present embodiment, the valve means 5 is located underneath the supply housing 6. Therefore, the hot water exit 7 and the cold water exit 8 proceed from the supply housing 6 downward towards the valve means 5. It is also possible to arrange the valve means above and parallel to the supply housing.

The valve means 5 in this embodiment has a mixing valve unit 9 and a check valve 10. The mixing valve unit 9 is used to mix the hot water and cold water to achieve mixed water of stipulated temperature. In this embodiment the mixing valve unit 9 is a thermostatic mixing valve unit. The check valve unit 10 is used to open and close a sanitary fitting 1 and to adjust the quantity. Feasibly, the check valve unit 10 is located in the flow direction behind the mixing valve unit 9; this means that the check valve unit 10 is located in a mixing water channel 11 of the fitting body 2. Basically, it would also be possible to arrange the check valve unit in the flow direction in front of the mixing valve unit.

To achieve the aforementioned compact design of the sanitary fitting 1, the mixing valve unit 9 and the check valve unit 10 are located on a lengthwise axis A, by which ultimately the elongated shape of the valve means 5 results. Furthermore, to ensure the low overall depth of the sanitary fitting 1, it is provided that the mixing water outlet 12 in the flow direction is located behind and underneath the valve means 5 and moreover, is pointed downward.

It is also basically possible to actuate the valve means manually via corresponding handle elements or actuation elements. These actuating elements take up a comparatively large amount of space. For this reason, in this embodiment there is a control means 14 which has a keyboard 13 for controlling the valve means 5. The individual components of the control means 14 are located together with the keyboard 13 on a board 15 which is located in front of the supply housing 6 of the fitting body 2. The board 15 is held on a mounting 16 which can be attached in turn to the fitting body 2 or the plumbing wall which is not shown.

All functions which can be also adjusted via manual actuation elements, specifically opening and closing and adjusting the amount and temperature, can be adjusted via keyboard 13. Furthermore, it is also possible to input certain individually user-specific programs via the keyboard 13 and the control means 14 which has a microprocessor.

For automatic adjustment of individual functions, a servo motors 17 and 18 to the control means 14 are assigned to both the mixing valve unit 9 and also the check valve unit 10. The connection of the respective servomotors 17, 18 with the mixing valve 9 or the check valve unit 10 takes place via the gear unit 19 with a pinion and a gear wheel 21. Downstream of the gear unit 19 is a servo unit which is made such that the rotary motion of the servomotors 17, 18 and gear wheels 21 is converted into translational movement of valve body 22 of the mixing valve unit 9 or the valve body of the check valve unit 10. Temperature and quantity adjustment therefore, takes place via back and forth motion of the respective valve body 22, and 23.

The servomotors 17, 18 themselves, including the respective gear units 19 are flanged to the fitting body 2 in the area of the mixing valve unit 9 and the check valve unit 10 via the corresponding flanges 24, 25 to achieve a sealing connection and for centering. By means of the aforementioned embodiment, underneath the supply housing 6 as viewed from left to right, there are in succession, the servomotor 17 with the pertinent gear unit 19 and the servo unit, the check valve unit 10, the mixing valve unit 9, the gear unit 19 with the servo unit and the servomotor 18 for the mixing valve unit 9.

In this embodiment, the mixing valve unit 9 has a proportional controller. By this proportional controller, rapid temperature control can be achieved. To eliminate the inevitable residual error of the proportional controller, there is a PID controller which is coupled to the servo motor 18 of the mixing valve unit 9. A temperature sensor 26 which is located in a mixing water channel 11, in this embodiment, behind the valve body 23 of the check valve unit 10, is assigned to the PID controller.

In addition to the motor-actuated check valve unit 10, the sanitary fitting 1 still has a manually activated check valve unit 27. This manual check valve unit 27 which in this embodiment is located in the flow direction behind the check valve unit 10, is used to actuate the sanitary fitting 1 if the motor-driven check valve unit 10 should fail. Although the manual check valve unit 27 is located in the mixing water channel 11 behind the motor-driven check valve unit 10, it goes without saying that this check valve unit 27 can also be located elsewhere.

The sanitary fitting 1 insert in accordance with the invention is battery-operated and for this purpose, has a battery compartment 28. The battery compartment 28 has an elongated, especially tubular shape and is located above the supply housing 6 roughly parallel to it. In the battery compartment 28, there can be a series of batteries 29 for supply of the control means 14 and the servomotors 17, 18. The battery compartment 28 can be made integrally with the mounting 16 of the board 15 and together with it, can be attached to the fitting body 2 and/or the plumbing wall. Instead of using batteries the sanitary fitting can also of course be connected to the electric grid.

For proper operation of the sanitary fitting 1, the keyboard 13 with the control means 14, the battery compartment 28, and the servo motors 17, 18 are sealed watertight via a cover 30 in the installed state of the sanitary fitting 1 relative to the plumbing wall. The cover 30 itself, which can also consist of several components, is made such that it can be easily opened or removed, at least in the area of the battery compartment 28. The keyboard 13 has pressure and/or proximity switches for actuation. In the area of the keyboard 13, the cover 30 is made such that the sanitary fitting 1 can be actuated either by pressure on the pressure switch or by approaching the proximity switch.

For direct attachment of the sanitary fitting 1 to the plumbing wall or for indirect attachment, for example via a frame which is not detailed here, attachment holes 31, 32, 33 are provided on the fitting body 2. In the attachment hole 33, there is (after embodiment, insert) in this embodiment a screw 34 via which the fitting body 2 can be screwed to a connection element (not shown) in the plumbing wall. In particular the, attachment holes 31, 32 however can also be used for attachment of the mounting 16.

The sanitary fitting 1 is connected to the water system via wall connections 35, and 36 which are made S-shaped. The wall connections 35, 36 each have a wall connection body 37 and a flange 38 which can be turned relative to the wall connection body 37 for connection to the fitting body 2 via the corresponding flanges 39. Also the wall connections 35, 36 used in conjunction with the sanitary fitting 1 contribute to achieving a low overall depth since screw connections, which take up a relatively large amount of space in the area of the hot water supply 3 and the cold water supply 4 in the supply housing 7, are unnecessary.

What is claimed is:

1. Sanitary fitting for attachment to a plumbing wall, said sanitary fitting comprising:

a fitting body with a common supply housing, said common supply housing having an elongated shape with a hot water supply and a cold water supply which are positioned, in use, in a supply plane substantially perpendicular to the plumbing wall;

a valve means for adjusting at least one of a quantity and a mixing of water flowing through said sanitary fitting, said valve means having an elongated shape and being located outside said supply housing underneath the supply plane and said common supply housing;

a control means and a keyboard for controlling said valve means, at least one of said control means and said keyboard being positioned in front of said supply housing;

at least one servomotor which is coupled to said control means for operating at least one of said mixing valve unit and said check valve unit; and a temperature sensor coupled to said servomotor via a controller, said temperature sensor being positioned behind said mixing valve unit;

wherein said valve means includes a thermostatic mixing valve unit and a check valve unit; and wherein a lengthwise axis of said valve means extends substantially parallel to a lengthwise axis of said supply housing.

2. Sanitary fitting of claim 1, further comprising hot water and cold water exits through which water flows from said common supply housing to said valve means, said hot water and cold water exits being positioned substantially perpendicular to the supply plane.

3. Sanitary fitting of claim 1, wherein said mixing valve unit and said check valve unit are positioned along the lengthwise axis of said valve means.

4. Sanitary fitting of claim 1, further comprising a mixing water outlet positioned behind and underneath said valve means, said mixing water outlet being pointed downwardly.

5. Sanitary fitting of claim 1, wherein said fitting body includes a flange adapted to sealingly support and center said servomotor in said sanitary fitting.

6. Sanitary fitting of claim 1, wherein said mixing valve unit includes a proportional controller.

7. Sanitary fitting of claim 6, further comprising a manually actuated check valve unit.

8. Sanitary fitting of claim 1, further comprising a manually actuated check valve unit.

9. Sanitary fitting of claim 1, wherein said fitting body includes a plurality of attachment holes for mounting said sanitary fitting to the plumbing wall.

10. Sanitary fitting for attachment to a plumbing wall, said sanitary fitting comprising:

a fitting body with a common supply housing, said common supply housing having an elongated shape with a hot water supply and a cold water supply which are positioned, in use, in a supply plane substantially perpendicular to the plumbing wall;

a valve means for adjusting at least one of a quantity and a mixing of water flowing through said sanitary fitting, said valve means having an elongated shape and being located outside said supply housing underneath the supply plane and said common supply housing;

a control means and a keyboard for controlling said valve means, at least one of said control means and said keyboard being positioned in front of said supply housing;

at least one servomotor which is coupled to said control means for operating at least one of said mixing valve unit and said check valve unit; and a battery compartment for holding batteries that supply power to said at least one servomotor and said control means;

wherein said valve means includes a thermostatic mixing valve unit and a check valve unit; and wherein a lengthwise axis of said valve means extends substantially parallel to a lengthwise axis of said supply housing.

11. Sanitary fitting of claim 10, wherein said battery compartment has an elongated shape and is positioned above and substantially parallel to said common supply housing.

12. Sanitary fitting of claim 10, wherein at least one of said keyboard, said at least one servo motor and said battery compartment are sealed watertight via a multipart cover.

* * * * *